US006568337B1

(12) United States Patent
Durville

(10) Patent No.: US 6,568,337 B1
(45) Date of Patent: May 27, 2003

(54) SEWING OR EMBROIDERY MACHINE

(75) Inventor: Gerard Durville, Gipf-Oberfrick (CH)

(73) Assignee: Fritz Gegauf Aktiengesellschaft Bernina-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 10/284,712

(22) Filed: Oct. 31, 2002

(30) Foreign Application Priority Data

Nov. 2, 2001 (CH) ..... 2001 2013/01

(51) Int. Cl.[7] ..... D05B 21/00
(52) U.S. Cl. ..... 112/102.5; 700/138
(58) Field of Search ..... 112/102.5, 103, 112/470.06, 475.19, 470.01; 700/138, 136, 137

(56) References Cited

U.S. PATENT DOCUMENTS 6,237,516 B1 5/2001 Wakayama

FOREIGN PATENT DOCUMENTS

| | | |
|---|---|---|
| DE | 3130371 | 5/1982 |
| DE | 29612102 | 10/1996 |
| DE | 29614512 | 11/1996 |

*Primary Examiner*—Peter Nerbun
(74) *Attorney, Agent, or Firm*—Volpe & Koenig, P.C.

(57) ABSTRACT

Identification elements for identifying the size, shape, and kind of embroidery frame (37) are installed on the embroidery frame (37) for a sewing or embroidery machine with an embroidery module (33). Furthermore, at least one reference cam (44) is provided on the embroidery frame (37), and by means thereof the precise position of the embroidery frame (37) relative to the embroidery module (33), and thus also relative to the needle (27), can be derived. By a comparison of the actual position of the embroidery frame (37) with the desired position, a fault can be detected and a new positioning of the embroidery frame (37) can be performed in the case, for example, that switching steps of the drive element in the embroidery module (33) have been lost.

3 Claims, 2 Drawing Sheets

SEWING OR EMBROIDERY MACHINE

BACKGROUND

The invention is directed to a sewing or embroidery machine with an embroidery module having an embroidery frame drive unit for driving differently sized interchangeable embroidery frames.

The embroidering of sewing material which is fixed in an embroidery frame and can be driven in X- and Y-directions by a drive unit is known. In embroidery machines, the drive unit is frequently a portion of the lower arm; in household sewing machines, the drive units, also termed embroidery modules, are held, docked in a play-free manner, on the sewing machine, i.e., on the lower arm and/or the baseplate. The connection between the embroidery frame and the drive unit takes place through an embroidery frame support which is connected to the drive elements in the drive unit, and holding and locking devices on the embroidery frame.

It is further known to arrange on the embroidery frame, impulse generating means, e.g., indentations, curves or bar codes, etc., with which the docked embroidery frame can be identified by the machine control (DE 29612102 U1) and/or with which the docking place can be identified on an embroidery frame (U.S. Pat. No. 6,237,516 B1), when plural docking places are present (DE 31 30 371 A1). Besides the unambiguous identification of the docked embroidery frame, the impulse generating control means also serve in DE 29612102 to indicate to the operator, on a display on the sewing machine, which embroidery frame (e.g., round, oval, square, etc.) is docked and in addition, at which docking place on the embroidery frame this has occurred. The information regarding the docking place also lets the operator know which sewing region within the embroidery frame can be embroidered. The pattern to be embroidered on the relevant sewing region can also be shown on the display.

It is therefore known from DE 29612102 to provide on the drive unit an identification of the kind and size of the docked embroidery frame, and to graphically display on a display device the sensed data relating to the kind and size of the embroidery frame. Furthermore, it is possible to determine, by means of the central machine control device, the desired relative position of the embroidery frame in relation to the needle and the stitch hole, and later to start the embroidery process from this reference position.

Thus the kind and size of the embroidery frame, and also the location of docking on embroidery frames with plural docking places, can be determined and therewith the relative position of the embroidery frame in relation to the needle. However, it is not possible to sense faults in the drive system, when for example steps of the stepping motor have been lost for any reason and consequently the embroidery frame support is not located at the desired position.

SUMMARY

The present invention therefore has as its object to provide a sewing or embroidery machine with a drive unit for an embroidery frame, with which drive unit there can be determined, not only the kind and size of the embroidery frame and the docking position on the embroidery frame, but in addition the exact present position of the embroidery frame with respect to the drive unit, and thereby to the needle position.

This object is attained by a sewing or embroidery machine having a reference element located on the embroidery frame for each impulse generating or triggering means connected to the drive unit as a control means. This compares the actual reference location sensed by the sensor of the reference element to the desired position of the embroidery frame in the holding device. Advantageous embodiments of the invention are defined in the dependent claims.

The arrangement of one or more reference points on the embroidery frame are situated respectively at a precisely defined distance from a reference zero point on the drive unit which makes it possible on the one hand to determine the exact position of the embroidery frame in relation to the reference zero point, and on the other hand also to determine whether the embroidery frame is correctly connected to the embroidery frame support, or to determine whether an embroidery frame is in fact docked to the embroidery frame support. With the knowledge of the exact present position with respect to the reference zero point, even when a deviation occurs, e.g., due to lost steps of the stepping motor in the drive unit, a correction can be automatically performed with the machine control, or the beginning of embroidery can be prevented. This makes it possible to guide and produce embroidery subjects over a surface extending over the embroidery region, without the positioning and subsequent points on the previously embroidered areas being visible after displacement of the embroidery frame.

BRIEF DESCRIPTION OF THE DRAWINGS

The invention is explained in detail based on a preferred embodiment shown in the drawings, in which.

DETAILED DESCRIPTION OF THE PREFERRED EMBODIMENTS

Figure 1:
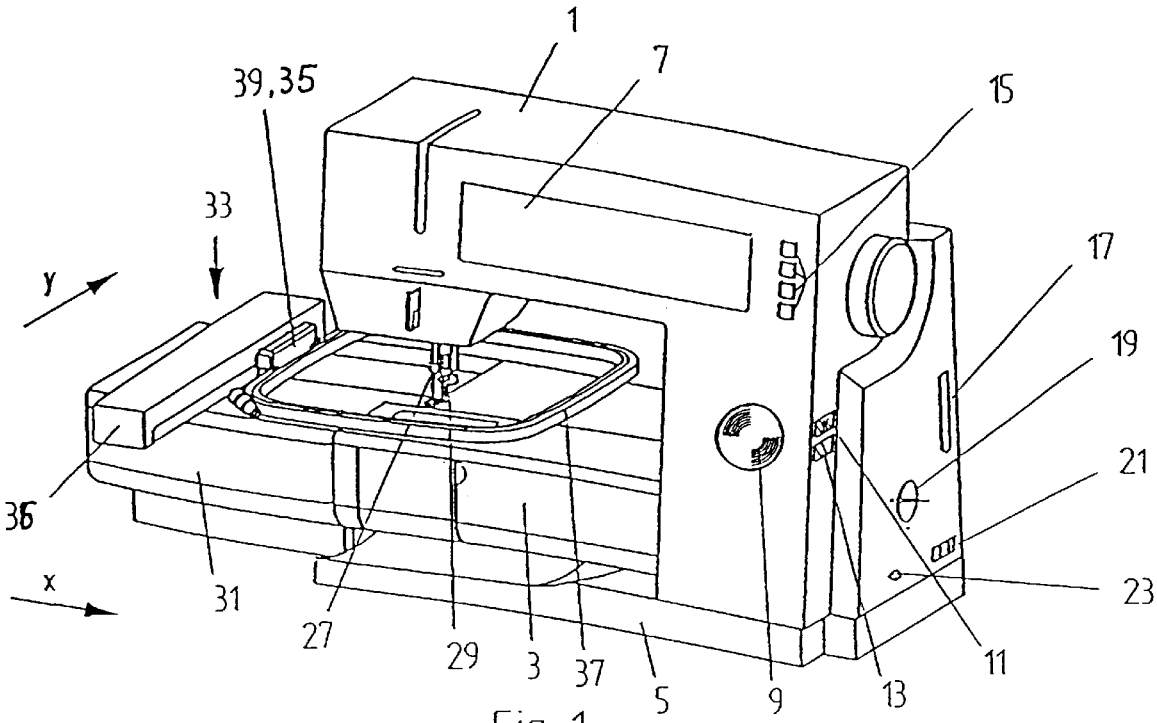
FIG. 1 is a perspective view of a sewing machine with a docked embroidery unit.

The sewing machine according to FIG. 1, only partially illustrated, includes the usual sewing elements, operating elements, and other equipment parts. It generally comprises the sewing machine housing 1, the free arm 3 and the baseplate 5. Arranged on the machine housing 1 are a display 7, a rolling ball 9 with associated actuating key 11 and cancel key 13, and a row of keys 15 for the direct choice of special functions which are not shown in detail. An opening 17 serves to receive external memory media, e.g., program cards for embroidery patterns. Below these are the main switch 19, the socket 21 for the power connection, and the socket 23 for the connection of a foot starter (not shown). The needle which cooperates through the stitch hole 25 with a gripper device (not shown) is denoted by 27, while the sewing foot which holds down the embroidery material (not shown) is denoted by 29.

The base unit 31 of an embroidery module 33, which can be connected to the sewing machine by mechanical and electrical connections (not shown), contains the program-controlled drive system (e.g., linear motors) for an embroidery frame support 35 of an embroidery frame drive unit 36 for driving the latter in the X-direction with the embroidery frame 37 attached thereto. The drive system for driving the embroidery frame 37 in the Y-direction are installed in the embroidery frame support 35. The embroidery frame 37 is connected by at least one releasable holding device 39 to the drive system arranged in the embroidery frame support 35. The construction of the holding device 39 is not described in detail.

Corresponding to the embroidery work to be carried out, different sizes or different shapes of embroidery frames 37 can be connected to the embroidery module 33.

Figure 2:
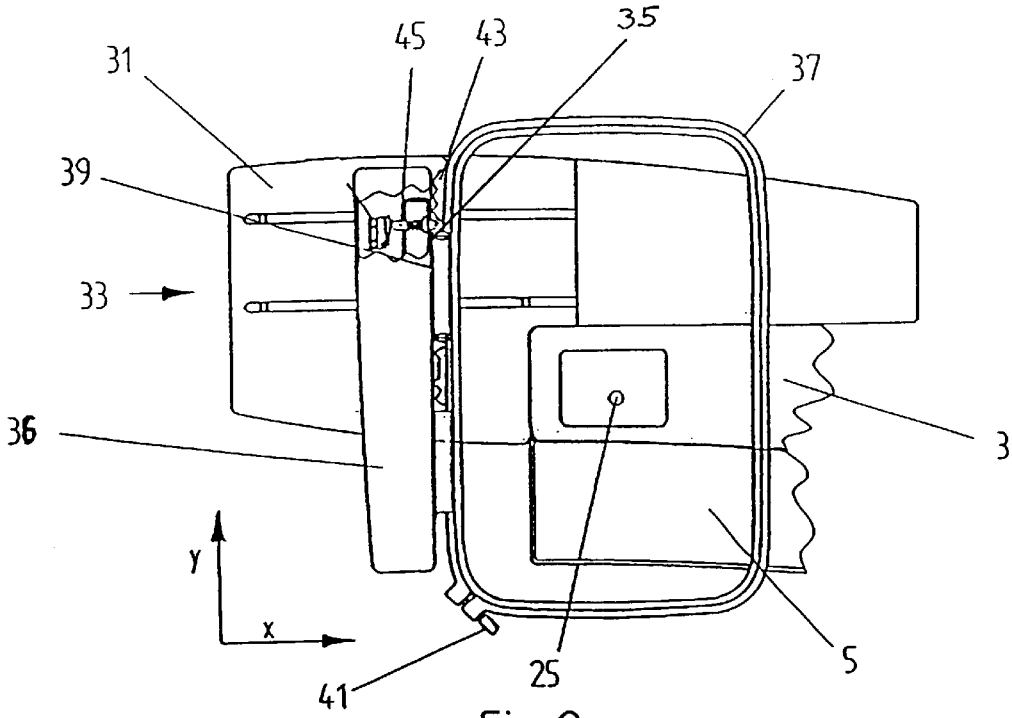
FIG. 2 is a top view of the sewing machine and embroidery unit according to FIG. 1.
Figure 3:
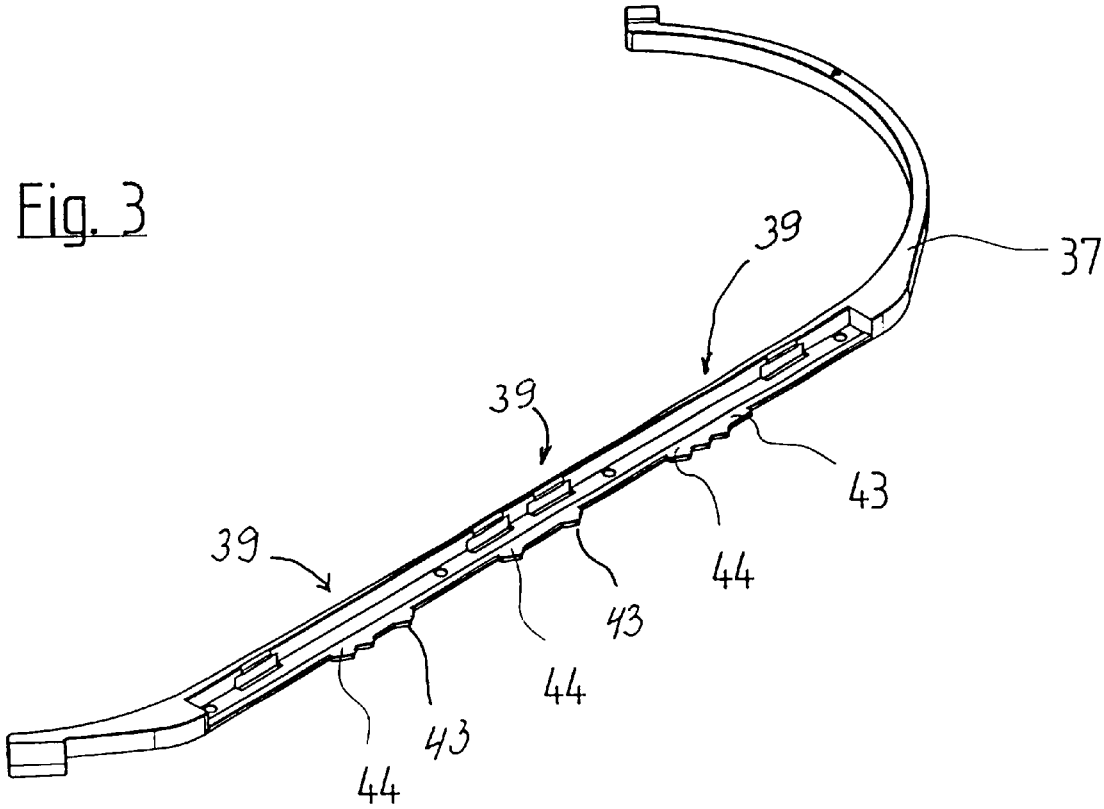
FIG. 3 is a partial view of an embroidery frame with plural docking places.
Figure 4:
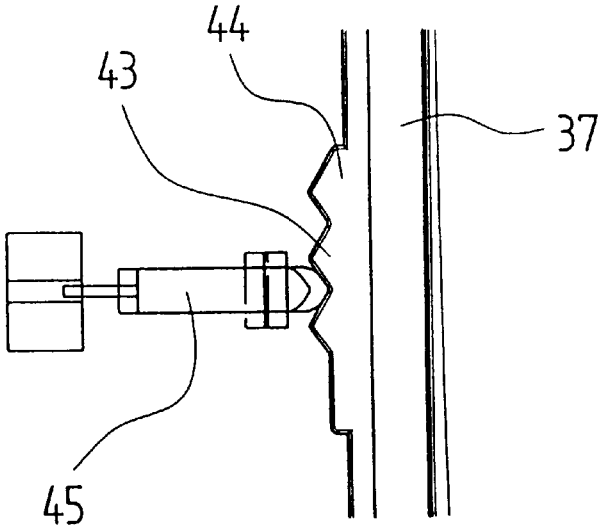
FIG. 4 is a top view of an impulse generating means and the sensor on the drive unit.

The rectangular embroidery frame 37 shown in FIG. 1 has only one holding device 39 on a narrow side thereof. In the top view according to FIG. 2, another, longer, embroidery frame 37 can be seen, with two holding devices 39 spaced apart on the longer side. FIG. 3 shows a portion of a still longer embroidery frame 37 with three holding devices 39. Each embroidery frame 37 includes at least one fixing device 41 with which the sewing material can be tightened.

In the examples shown, each holding device 39 includes one or more control cams or control indentations (impulse generating or triggering means) 43, and in addition a respective reference cam or reference indentation 44. The latter have a precisely predetermined position in relation to the embroidery frame 37. With the reference cam 44, together with the precisely known position of the drive unit 36, the actual position of the embroidery frame 37 can be compared with the desired position and, in the case that deviations are detected, a correction can be effected. The position of the embroidery frame 37 can be corrected when, for example, steps of a stepping motor serving as the drive have been lost. A correction of the position of the embroidery frame 37 is of course not performed when the reference cam 44 cannot be detected because the embroidery frame 37 is not docked, or is incompletely docked, on the holding device 39. The reference cam. 44 accordingly has plural functions, which serve to ensure faultless operation: it determines whether the actual position of the embroidery frame 37 coincides with the desired position, and makes a correction possible. Furthermore, it ensures faultless fastening to the holding device 39 and stops the sewing machine when one of the parameters is incorrect.

For sensing the control cam 43 and the associated reference cam 44, an impulse generating control means such as a feeler pin 45 or a light beam, a proximity sensor or another sensing element is installed in a fixed location and can sense an identification of the control cam 43 and the reference cam 44 during a relative motion between the embroidery frame 37 and the embroidery module 33, or during docking. The number, the position, and/or the geometric shape of the control cams 43 are the basis for the detection of the embroidery frame position and of the size and shape and also docking position of the embroidery frame 37. The reference cam 44 serves for the precise and fault free positioning of the embroidery frame 37 relative to the embroidery module 33.

The mode of operation is explained in detail hereinafter. The operator searches for the embroidery frame 37 which matches the embroidery pattern to be produced, fixes therein the sewing material, in the form of a textile structure, with the tensioning device 41, and then docks the embroidery frame 37 onto the embroidery module 33. The embroidery module 33 then guides the embroidery frame 37 in the Y-direction past the impulse generating feeler pin 45. This senses from the control cam 43 the data of the docked embroidery frame 37 and the docking position, in the case that the embroidery frame 37 has plural docking positions. Determination of the exact position of the embroidery frame 37 relative to the drive unit 36 is ensured by the reference cam 44. Fault free fastening is checked at the same time. If the fastening between the embroidery frame 37 and the holding device 39 is not correct, the sewing machine is then prevented from beginning the embroidery process. If a difference between the actual and desired positions is detected, a correction then takes place, i.e., the embroidery frame 37 is moved to the correct, desired position before the embroidery process begins. A precisely defined reference point, i.e., a precisely defined position on the embroidery module 33 relative to the needle 27, serves as the reference. The checking of the desired/actual position can be repeated periodically or on each pass of the reference cam 44 past the feeler pin 45.

The identification and adjusting means according to the invention make possible embroidery of a sewing material true to pattern, even in an embroidery frame 37 whose embroidery field is greater than the working region of the sewing machine. The pattern overlapping the working region of the sewing machine can accordingly be completed sectionally, and the neighboring areas can be seamlessly continued after the displacement of the embroidery frame 37. A costly division of the embroidery pattern into connected individual patterns, as is proposed in U.S. Pat. No. 6,237,516 B1, is not necessary. The first puncture location of the needle 27 after an embroidery frame displacement is precisely calculated by the machine control. The operator consequently does not have to perform any adjustment, as is proposed, for example, in U.S. Pat. No. 5,835,113.

What is claimed is:

1. Sewing or embroidery machine comprising an embroidery module (33) with an embroidery frame drive unit (36) for driving differently sized interchangeable embroidery frames (37) in X and Y directions, an embroidery frame support (39) on the embroidery frame drive unit (36) for releasable connection of the embroidery frame (37) to the drive unit (36), and an embroidery frame (37) with an embroidery frame holding and locking device (39) for the production of a play-free connection between the drive unit (36) and the embroidery frame (37), impulse-triggering means (43) located on the embroidery frame (37) and impulse-generating control means (45) relocated on the drive unit (36) for identifying the docked embroidery frame (37), wherein on the embroidery frame (37) a reference element (44) is allocated to each impulse triggering means (43) and can be identified and read by a stationary sensor (45) connected to the drive unit (35) as a control means, and which compares an actual reference location sensed by the sensor (45) on the reference element (44) with a desired position of the embroidery frame (37) relative to the holding device (39).

2. Sewing and embroidery machine according to claim 1, wherein the reference element for determining the reference position comprises at least one reference cam (44) whose geometric position on the embroidery frame (37) is precisely defined.

3. Sewing and embroidery machine according to claim 1, wherein the actual position of the embroidery frame (37) relative to the drive unit (36) can be checked on each pass of the reference elements (43, 44) past the pulse generating control means (45) and can be corrected by a machine control.

* * * * *